US012037778B2

(12) United States Patent
Emmerling et al.

(10) Patent No.: US 12,037,778 B2
(45) Date of Patent: Jul. 16, 2024

(54) TILE-ON RIM TOILET

(71) Applicant: Kohler Co., Kohler, WI (US)

(72) Inventors: John F. Emmerling, Howards Grove, WI (US); John A. Zutz, Valders, WI (US)

(73) Assignee: Kohler Co., Kohler, WI (US)

( * ) Notice: Subject to any disclaimer, the term of this patent is extended or adjusted under 35 U.S.C. 154(b) by 197 days.

(21) Appl. No.: 16/582,608

(22) Filed: Sep. 25, 2019

(65) Prior Publication Data

US 2020/0102730 A1 Apr. 2, 2020

Related U.S. Application Data

(60) Provisional application No. 62/738,433, filed on Sep. 28, 2018.

(51) Int. Cl.

| | |
|---|---|
| ***E03D 11/10*** | (2006.01) |
| ***E03D 11/08*** | (2006.01) |
| ***E03D 11/13*** | (2006.01) |

(52) U.S. Cl.

CPC ..... *E03D 11/10* (2013.01); *E03D 11/08* (2013.01); *E03D 11/13* (2013.01); *E03D 2201/40* (2013.01)

(58) Field of Classification Search

CPC ..... E03D 11/08; E03D 11/10; E03D 11/13; E03D 2201/40

USPC ..... 4/420

See application file for complete search history.

(56) References Cited

U.S. PATENT DOCUMENTS 1,435,644 A * 11/1922 Kelly ..... E03D 11/06 264/250
3,664,799 A * 5/1972 Wallick, Jr. ..... B28B 3/003 425/405.2
3,843,977 A * 10/1974 Garnett ..... E03D 11/02 4/421

(Continued)

FOREIGN PATENT DOCUMENTS

CN 105189881 A 12/2015
CN 108000681 A 5/2018

(Continued)

OTHER PUBLICATIONS

JP-2004011413-A Machine Translation (Year: 2023).*
Chinese Office Action for Chinese Application No. 201910931569.2 dated Aug. 28, 2020.

*Primary Examiner* — David P Angwin
*Assistant Examiner* — William R Klotz
(74) *Attorney, Agent, or Firm* — Lempia Summerfield Katz LLC

(57) ABSTRACT

A toilet having a water inlet structure, a bowl structure, a rim, and an outlet structure. The water inlet structure is configured to receive water from a water source. The bowl structure includes a toilet bowl and a water channel, which is fluidly connected to the water inlet structure and is configured to feed water into the toilet bowl from an outlet of the water channel that is located between a back portion and a side portion of the toilet bowl. The rim has a solid, annular member disposed around a top of the toilet bowl and entirely above the water channel, is formed separately from and coupled to the bowl structure. The outlet structure is fluidly connected to the toilet bowl to carry the water and contents from the toilet bowl to an outlet.

20 Claims, 5 Drawing Sheets

(56) References Cited

U.S. PATENT DOCUMENTS

| | | | | |
|---|---|---|---|---|
| 4,145,772 | A * | 3/1979 | Whitney | E03D 1/286 4/300 |
| 4,246,666 | A * | 1/1981 | Stansbury, Jr. | E03D 11/10 4/441 |
| 6,019,862 | A * | 2/2000 | Cardwell | C04B 37/001 264/633 |
| 6,247,193 | B1 * | 6/2001 | Riepl | E03D 11/06 4/421 |
| 6,779,996 | B2 | 8/2004 | Bergquist et al. | |
| 7,353,577 | B2 | 4/2008 | Davies et al. | |
| 8,336,128 | B2 | 12/2012 | Murphy | |
| 8,640,272 | B2 * | 2/2014 | Morita | E03D 11/06 4/420 |
| 9,260,851 | B2 | 2/2016 | Yamasaki | |
| 9,938,706 | B2 | 4/2018 | Matsunaga | |
| 10,253,489 | B2 | 4/2019 | Yamasaki | |
| 10,301,809 | B2 | 5/2019 | Kitamura et al. | |
| 10,378,195 | B2 * | 8/2019 | Urata | E03D 11/08 |
| 2005/0115042 | A1 * | 6/2005 | Davies | B28B 1/26 29/401.1 |
| 2009/0019630 | A1 * | 1/2009 | Bernabei | B28B 1/002 4/420 |
| 2013/0047330 | A1 * | 2/2013 | Yamasaki | E03D 11/13 4/431 |
| 2015/0197928 | A1 | 7/2015 | Mchale et al. | |
| 2015/0267389 | A1 | 9/2015 | Luettgen et al. | |
| 2017/0306601 | A1 | 10/2017 | Harris | |
| 2022/0049485 | A1 * | 2/2022 | Ahola | E03D 11/02 |

FOREIGN PATENT DOCUMENTS

| | | | |
|---|---|---|---|
| CN | 108252385 | A | 7/2018 |
| GB | 403585 | A | 7/1933 |
| GB | 519533 | A | 9/1938 |
| JP | 2004011413 | A * | 1/2004 |
| JP | 2004011413 | A | 1/2004 |
| JP | 2006089971 | A | 9/2004 |
| JP | 2009197545 | A | 9/2009 |
| JP | 2015134993 | A | 7/2015 |

* cited by examiner

TILE-ON RIM TOILET

CROSS-REFERENCE TO RELATED PATENT APPLICATIONS

This application claims the benefit of and priority to U.S. Provisional Patent Application No. 62/738,433, filed Sep. 28, 2018. The aforementioned U.S. application is incorporated herein by reference in its entirety.

TECHNICAL FIELD

The present application relates generally to the field of toilets. More specifically, this application relates to toilets, such as swirl-flush toilets, having a tile-on rim configuration.

BACKGROUND

Toilets can be configured to have various flush designs (i.e., different manners in which water may circulate into and within a toilet bowl from a water inlet). The most common design is a box rim design where, upon flushing, water may be flushed downward from a channel located within a rim, which extends around an upper perimeter of the bowl. However, a swirl design is also possible, where, upon flushing, water may be dispensed through an opening in a back or a side portion of the bowl, and may be directed in a direction around the bowl, providing a "swirl" cleaning effect around the bowl. Box rim designs generally have a series of holes formed on a lower surface of the rim through which water is distributed along the entire perimeter of the bowl. Forming the box rim with a series of holes creates a more complex manufacturing process, as it often requires additional forming steps to create the bowl (e.g., having a channel, or "box" rim) and the series of holes within the rim. The additional complexity may result in increased scrap rates during production, as well as more workers to perform the forming steps. In addition, due to the need to have multiple steps to create a single, integrated unit, storing inventory during this process may require a large amount of space.

SUMMARY

At least one embodiment of the application relates to a toilet having a water inlet structure, a bowl structure, a rim, and an outlet structure. The water inlet structure is configured to receive water from a water source. The bowl structure includes a toilet bowl and a water channel, which is fluidly connected to the water inlet structure and is configured to feed water into the toilet bowl from an outlet of the water channel that is located between a back portion and a side portion of the toilet bowl. The rim has a solid, annular member disposed around a top of the toilet bowl and entirely above the water channel, and is formed separately from and coupled to the bowl structure. The outlet structure is fluidly connected to the toilet bowl to carry the water and contents from the toilet bowl to an outlet.

At least one embodiment of the application relates to a toilet base or pedestal, which includes a bowl structure and a rim structure. The bowl structure includes a bowl defining an opening at a top thereof and having an outlet; a rear portion extending from a rear of the bowl and having an inlet channel; and a water channel that fluidly connects the bowl to the inlet channel. The rim structure is separate from and coupled to the bowl structure. That is, the rim structure is formed separately from the bowl structure. The rim structure includes a solid, annular member and a rear portion. The solid, annular member is disposed on the top of the bowl and around the opening of the bowl, with a bottom of the solid, annular member defining a top of the water channel. The rear portion is disposed on the rear portion of the bowl and has an inlet opening fluidly connected to the inlet channel, with the rear portion of the rim structure defining a top of the inlet channel.

At least one embodiment of the application relates a method of forming a toilet including forming a bowl structure. The bowl structure includes a bowl defining an opening at a top thereof and having an outlet, a rear portion extending from a rear of the bowl and having an inlet channel, and a water channel that fluidly connects the bowl to the inlet channel. The method includes forming a rim structure separately from the bowl structure, where the rim structure includes a solid, annular member and a rear portion extending from a rear of the solid, annular member. The method includes coupling the rim structure to the bowl structure, such that the solid, annular member is disposed on the top of the bowl and surrounds the opening of the bowl. A bottom of the solid, annular member defines a top of the water channel. The rear portion of the rim structure is disposed on the rear portion of the bowl, has an inlet opening fluidly connected to the inlet channel, and defines a top of the inlet channel.

DETAILED DESCRIPTION

Figure 1:
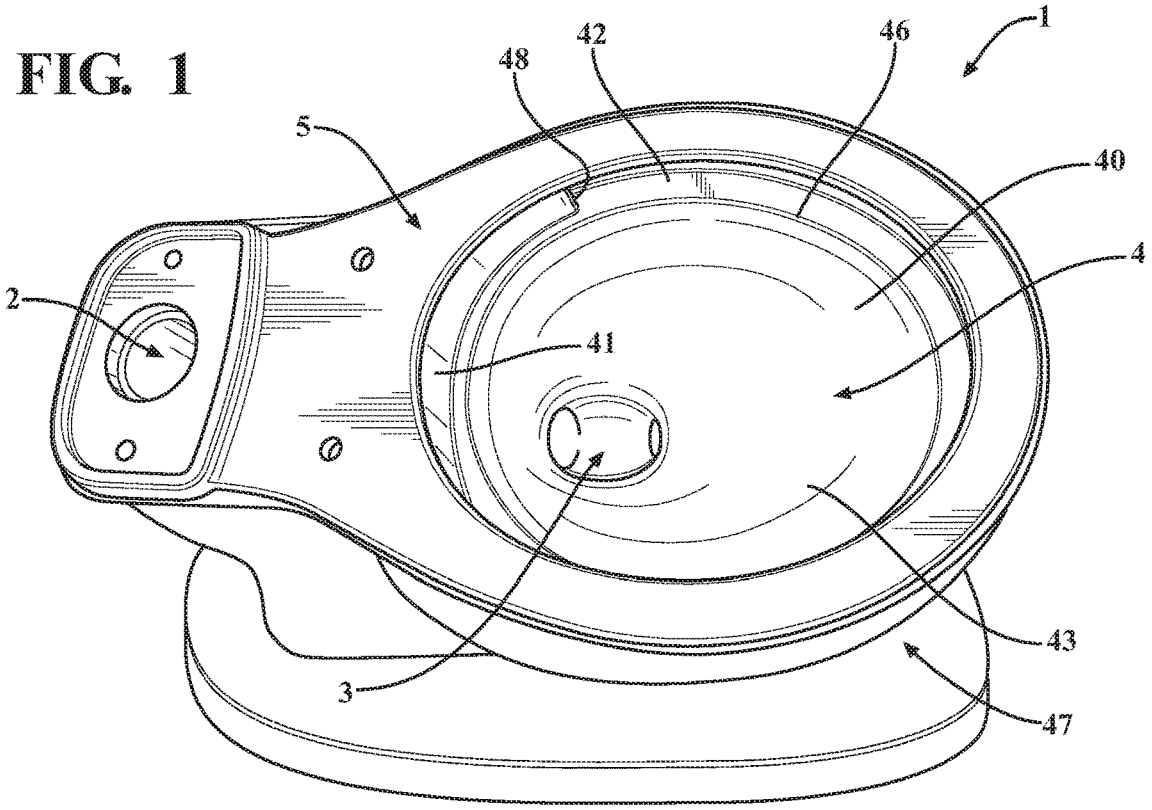
FIG. 1 is a perspective view of a toilet structure, according to an exemplary embodiment of the present application.

Referring generally to the FIGURES, disclosed herein are toilet structures (e.g., pedestals, bases, etc.) for toilets having tile-on rims. The tile-on rim includes a solid and annular member, which couples to an upper surface of a bowl structure of a toilet. The tile-on rim may be planar including a flat top and/or a flat bottom surfaces, depending on the embodiment. The tile-on rim (e.g., rim structure) is formed separately from the bowl structure, and subsequently coupled to the bowl structure by way of a bonding material and/or one or more fasteners. The bonding material includes adhesives, cements, and any other material that is capable of permanently coupling (e.g., bonding, fusing, etc.) the rim structure and the bowl structure together. By way of non-limiting example, the material can be a clay, ceramic or vitreous (e.g., a "slip-roll" clay) that is applied to one or both of the rim and bowl structures as a paste or malleable solid, such as a semi-liquid and semi-solid material, then heated (e.g., in a kiln or oven) to permanently fuse the structures together. The tile-on rim is disposed entirely above a water channel, such that, instead of having an internal channel with vertical holes formed within the rim to direct flush water for cleaning the inner surface of a toilet bowl, the water channel supplies water into the toilet bowl outside of (e.g., below) the rim. For example, water can be supplied through an outlet (e.g., single outlet) located between a back portion and side portion of the toilet bowl, a jet, a combination thereof, or through other ways in the bowl structure. In this way, locating the water channel outside of the rim structure allows the rim to exclude features designed to carry water within. Accordingly, the tile-on rim of the present disclosure reduces manufacturing time and cost, such as by reducing the number of steps to form the toilet structure (e.g., the steps that would otherwise be required to form holes or a channel within the rim).

FIGS. 1-7 illustrate an exemplary embodiment of a toilet structure having a tile-on rim. The illustrated toilet structure 1 includes a water inlet structure 2, an outlet structure 3 (e.g., a trapway), a bowl structure 4, and a tile-on rim 5 (e.g., rim structure). The water inlet structure 2 is configured to receive water from a water source (e.g., toilet tank, water line, etc.) and feed water into a toilet bowl 40 (e.g., through a channel), to both move the contents from the bowl through the outlet structure 3, as well as to clean the inside surface(s) of the toilet bowl 40. The outlet structure 3 is fluidly connected to the toilet bowl 40 to carry the water and the contents from the toilet bowl 40 away from the toilet structure 1 (e.g., into a drainpipe). The bowl structure 4, which fluidly connects the water inlet structure 2 to the outlet structure 3, includes the toilet bowl 40 and a water channel 45. The bowl structure 4 is configured to feed water into the toilet bowl 40 from an outlet 48 of the water channel 45 that is located between a back portion 41 (e.g., back wall) and a side portion 42 (e.g., back wall) of the toilet bowl 40. The tile-on rim 5 has a solid, planar, and annular member disposed around a top of the toilet bowl 40 and entirely above the water channel 45, which is configurable to receive a seat for supporting a user of the toilet structure 1.

Figure 2:
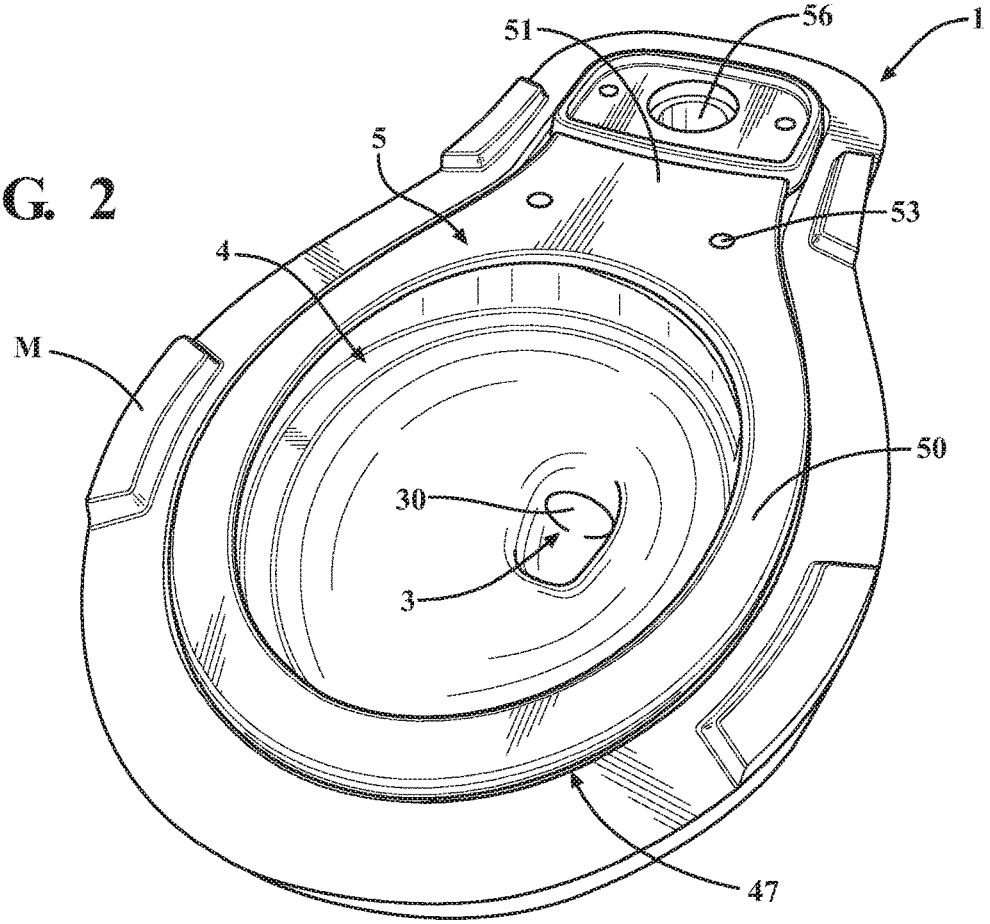
FIG. 2 is a perspective view of the toilet structure shown in FIG. 1 in an assembly mold.
Figure 5:
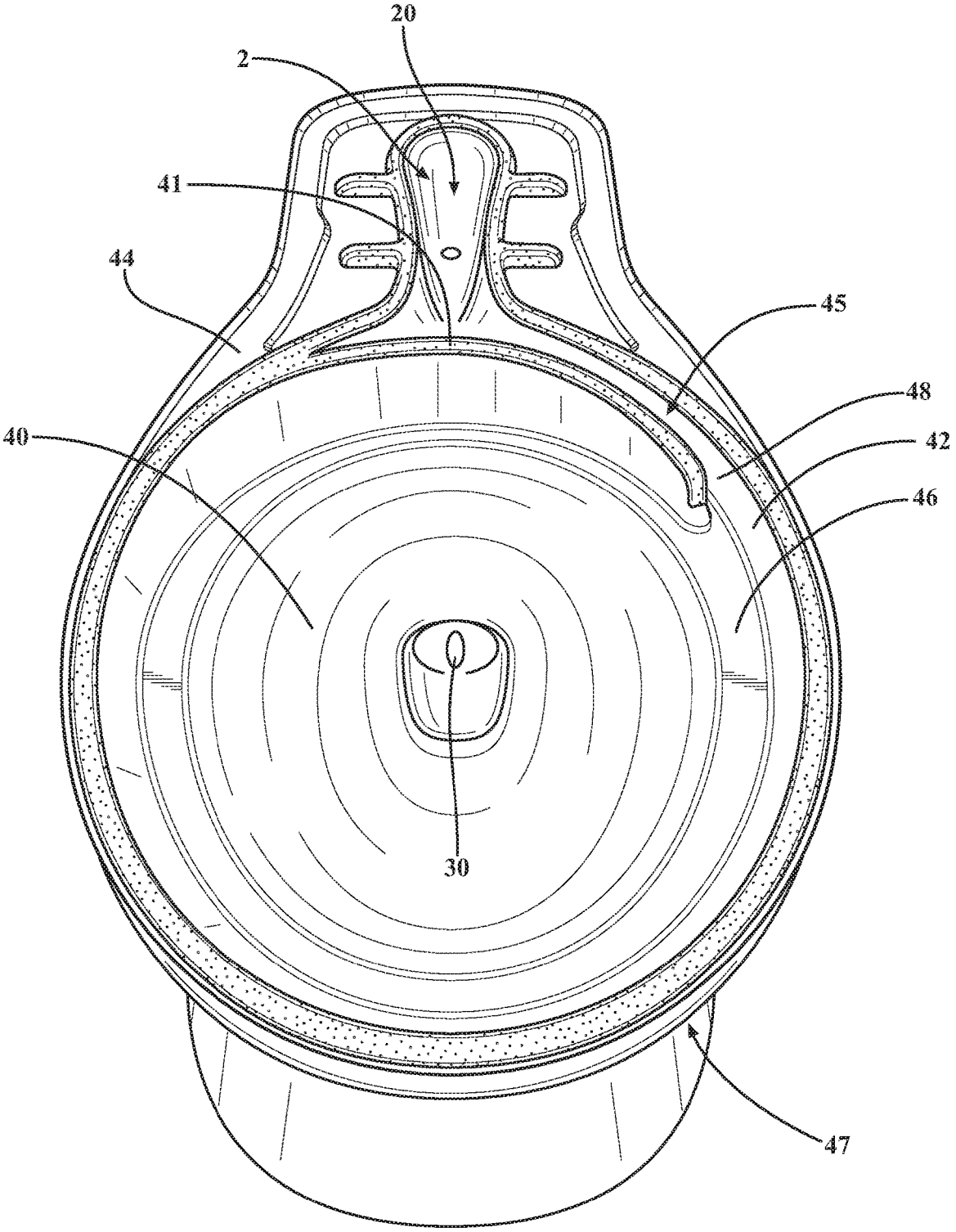
FIG. 5 is a top perspective view of an exemplary embodiment of a bowl structure prior to coupling on the tile-on rim structure to form the toilet structure shown in FIG. 1.
Figure 6:
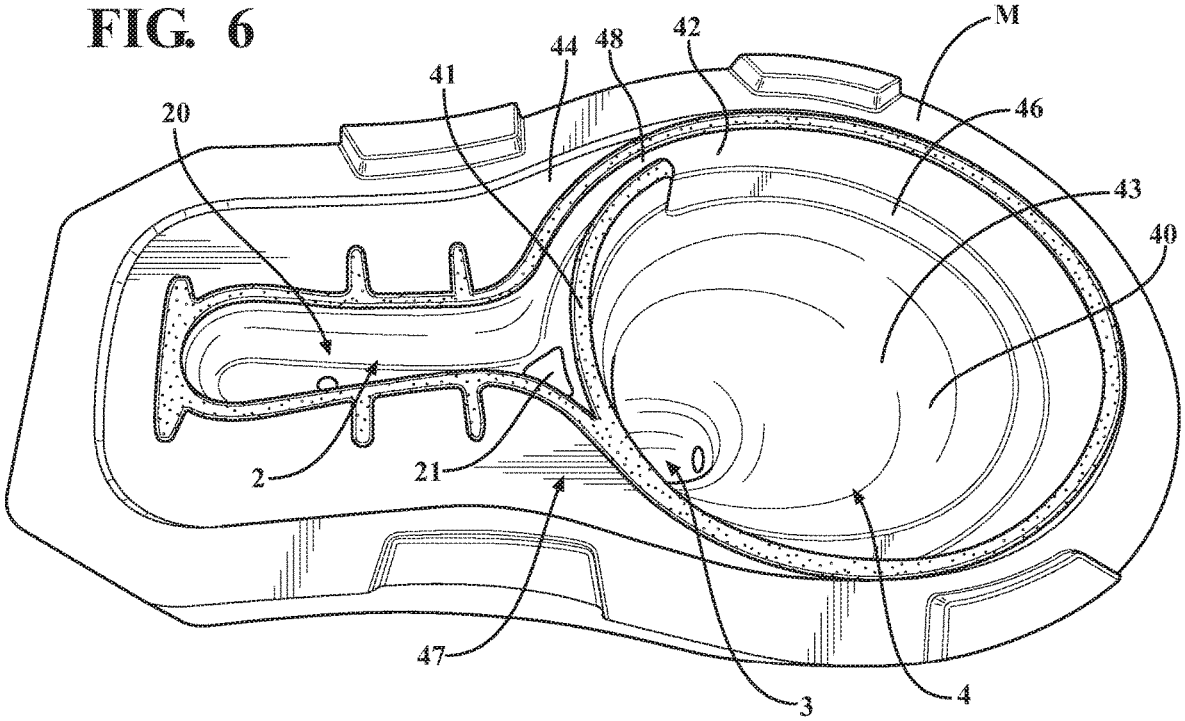
FIG. 6 is a top perspective view of the bowl structure shown in FIG. 5 prior to coupling on the tile-on rim structure with the bowl structure in an assembly mold.
Figure 7:
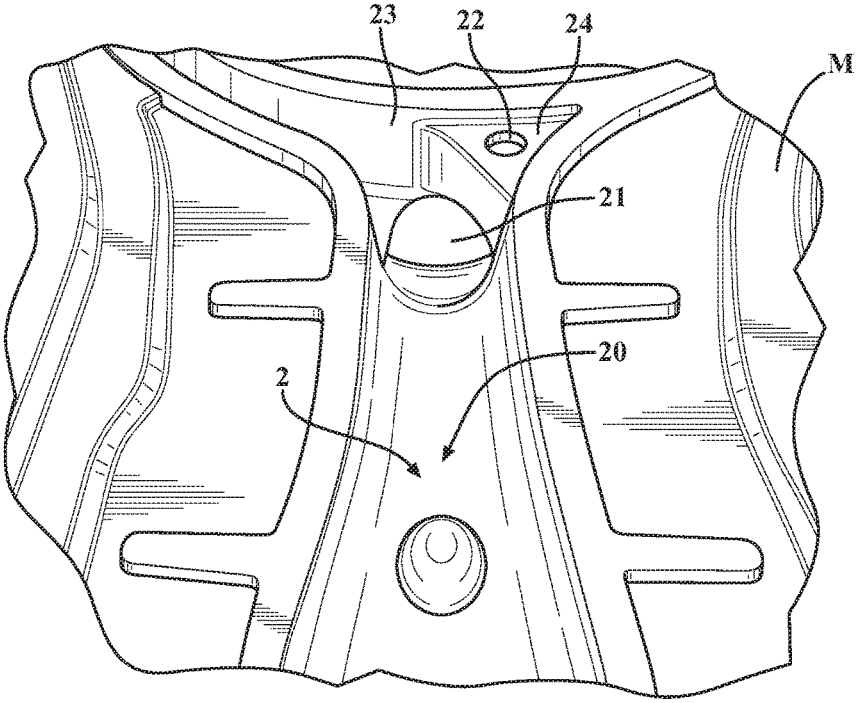
FIG. 7 is a perspective detail view of a portion of the bowl structure shown in FIG. 6.

As shown in FIGS. 5-7, the water inlet structure 2 includes an inlet channel 20 for introducing water into the toilet bowl 40. As shown, the inlet channel 20 fluidly connects to the water channel 45 to supply water to the toilet bowl 40 through the water channel 45. The toilet may optionally include one or more jets, where each jet supplies water to the toilet bowl 40. As shown in FIG. 7, a jet supply hole 21 (e.g., an inlet port) fluidly connects and supplies water to a jet (e.g., a jet orifice) through a fluid conduit, channel or other feature. Each jet can be located in a sump of the toilet bowl 40 (e.g., front, rear and/or side location in the sump) or elsewhere in the bowl (e.g., above the sump). If the toilet includes a jet, the toilet can include a vent hole 22 that allows air in the system (e.g., jet channel) to be directed to the rim channel (rather than being blown out of the jet orifice). The water inlet structure 2 is configurable to receive water from a water source, such as a water tank. Specifically, the water source (e.g., a tank) can provide water to the inlet channel 20 through an opening 56 of the rim 5 (FIGS. 1 and 2). The inlet channel 20 is fluidly connected to the water channel 45 and the jet supply hole 21 at a forward end of the inlet channel 20. Thus, for the illustrated toilet, the inlet channel 20 supplies water to the water channel 45 and the jet supply hole 21 upon activation of a flush cycle. The jet supplies water to the bowl to be evacuated through the outlet structure 3 (e.g., the trapway) upon a flush activation to assist in the flush cycle. The illustrated vent hole 22 is a downwardly extending bore disposed on a ledge 24, which is elevated from a bottom of the inlet channel 20 and is located at the forward end of the inlet channel 20. Upon assembly of the rim 5, the vent hole 22 will be spaced apart from a bottom or lower surface 55 of the rim 5. Upon an activation of a flush cycle, water enters and flows forward through the inlet channel 20, where a forward wall 23 diverts a first flow of water into the water channel 45 to enter the toilet bowl 40 and a second flow of water to the jet supply hole 21.

The outlet structure 3 includes an inlet 30, which fluidly connects to the toilet bowl 40, an outlet, and a trapway extending between the inlet 30 and the outlet to carry water and waste contents from the toilet bowl 40 to a drainpipe or sewer system. For example, the trapway may include and extend between the inlet 30 and the outlet. As shown in FIG. 5, the inlet 30 of the outlet structure 3 fluidly and operatively connects or couples to an outlet in a lower portion of the toilet bowl 40, such as the sump of the bowl. The outlet of the outlet structure 3 fluidly connects to a drainpipe. Although the toilet structure 1 is configurable for siphonic toilets, which utilize a vacuum formed within the outlet structure 3 during a flush cycle to pull the contents of the toilet bowl 40 through the outlet structure 3 to the drainpipe, the toilet structure 1 can be employed with or in any other type of toilet. By way of example, the rim and toilet concepts of this application are configurable for use in wash-down toilets, wall-hung toilets, floor mount toilets, one piece toilets, two piece toilets, as well as other types of toilets. Additionally, the trapway can be integrally formed with or formed separately from and coupled to other components/elements of the toilet. The trapway can selectively hold a volume of water, and fluidly connects the inlet 30 and the outlet of the outlet structure 3, such that the inlet 30 is disposed at one end, and the outlet is disposed at the other end. The trapway can receive water from the one or more jets, if provided, such that each jet supplies water to the same or different parts of the outlet structure 3 upon an activation of a flush cycle. For example, water supplied through the jet supply hole 21 coupled with the water entering the toilet bowl 40 through the water channel 45, may induce a siphon (e.g., vacuum pressure) within the outlet structure 3. The vacuum pressure causes the water and contents from the toilet bowl 40 to be carried through the outlet structure 3 to a drainpipe or sewer system.

The illustrated bowl structure 4 includes a toilet body 47 having a toilet bowl 40, which defines an inlet opening and an outlet, and a water channel 45. The bowl structure 4 fluidly connects the water inlet structure 2 to the outlet structure 3, and is configurable to receive and contain water and waste within the toilet bowl 40. Specifically, the water channel 45 is fluidly connected to the water inlet structure 2 and is configured to feed water into the toilet bowl 40 from an outlet 48 of the water channel 45 that is located between a back portion 41 and a side portion 42 of the toilet bowl 40. As shown in FIGS. 5-6, the outlet 48 of the water channel 45 is about halfway between the back portion 41 and side portion 42 of the toilet bowl 40. The water channel 45 fluidly connects the inlet channel 20 of the water inlet structure 2 to an inner surface 43 of the toilet bowl 40. The water channel 45 is configurable to feed water into the toilet bowl 40, such that the water swirls around an inner surface 43 of the toilet bowl 40 before entering the outlet structure 3. The illustrated toilet bowl 40 includes a shelf 46 around at least a portion of a perimeter of an upper portion of the toilet bowl 40. The shelf 46 is shown to be slightly recessed outwardly from the inner surface 43 of the toilet bowl 40 to provide a path for the water to flow. As shown in FIGS. 1, 5 and 6, the shelf 46 extends more outwardly (i.e., the shelf 46 is wider) along the front portion and side portions 42 forward of the outlet 48 of the water channel 45 of the toilet bowl 40 than the back portion 41. In operation of at least one embodiment, as the jet supplies water into the bowl structure from the jet supply hole 21, water also flows through the water channel 45 and enters the toilet bowl along a side portion 42 and on the shelf 46 inducing swirling of the water around the inner surface 43 (e.g., in a clockwise manner). The shelf 46 is configured to direct water in a single rotational direction (e.g., clockwise or counterclockwise depending on the location and configuration of the water channel 45) around the shelf 46 and the inner surface 43 of the toilet bowl 40, resulting in a swirl flush. Thus, the swirl pattern provided by the configuration of the water channel 45 and the shelf 46 may ensure improved cleaning by the water as it feeds into the toilet bowl 40 using as little water as possible to cover the inner surface 43 of the toilet bowl 40.

Figure 3:
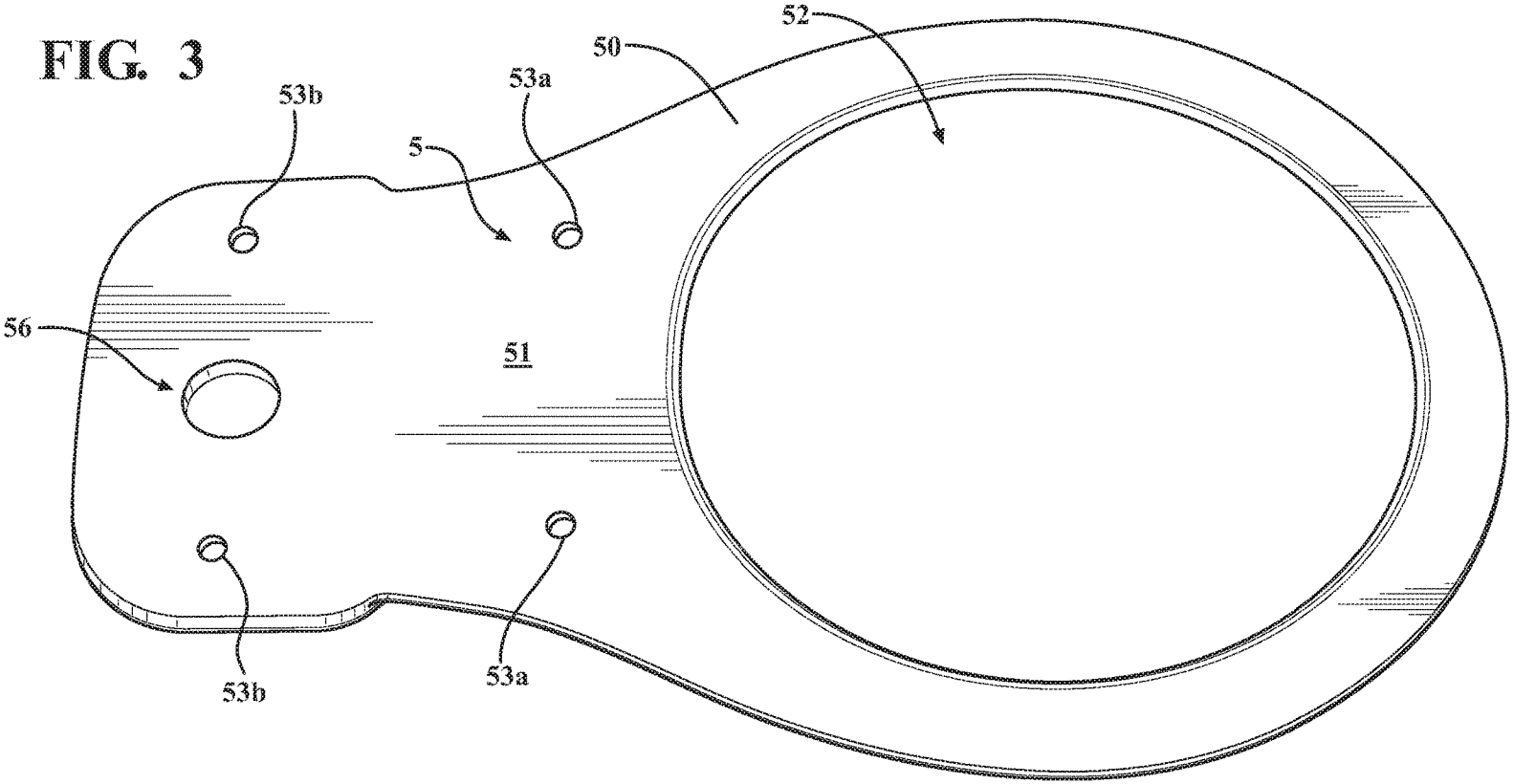
FIG. 3 is a bottom perspective view of an exemplary embodiment of a tile-on rim structure prior to coupling to the bowl structure to form the toilet structure shown in FIG. 1.
Figure 4:
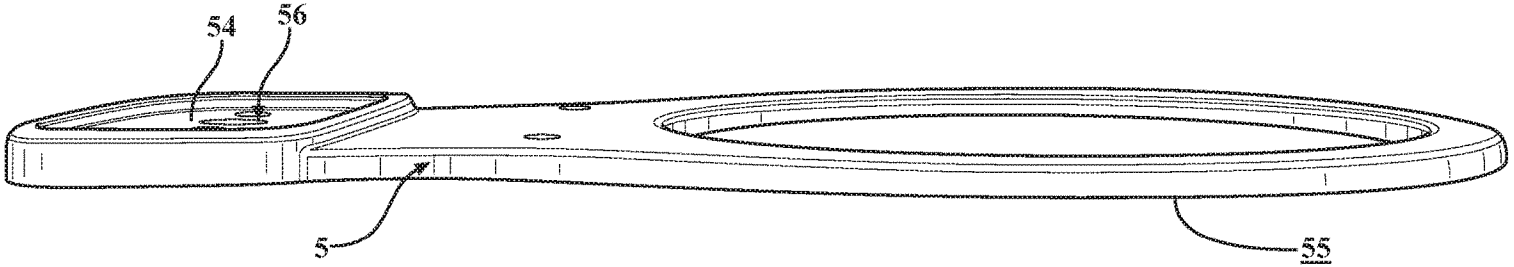
FIG. 4 is a side perspective view of the tile-on rim structure shown in FIG. 3.

The illustrated rim 5 includes a solid, planar (e.g., flat), and annular member disposed around a top of the toilet bowl 40 and entirely above the water channel 45. That is, the rim 5 is solid and does not include a rim channel, fluid channel, or other fluid delivery or water carrying features. Further, the solid, annular member does not have to be planar or flat, but can include one or more contours (e.g., steps, curves, etc.) on either a top or a bottom thereof, such as to aid in coupling to the bowl, to improve flow of water/waste, support a seat, or for other reasons. The illustrated rim 5 is formable using a molding or casting process. As shown in FIGS. 3-4, the rim 5 is formable in a mold and is made of a porcelain or vitreous material. However, the rim 5 can be made using other processes and/or including other materials. No matter the process or material, the tile-on rim 5 (e.g., rim structure) is made separately from the bowl structure 4, and subsequently coupled to one another. The rim 5 includes an annular forward portion 50, which has or defines an inlet opening 52, and a back portion 51 extending from a rear of the forward portion 50. The forward portion 50 is configurable to receive a seat for supporting a user, where the seat may be disposed above the forward portion 50 of the rim 5. The back portion 51 can optionally include a plurality of through-going bores 53 (e.g., through holes), which extend between an upper surface (e.g., surface 54) and a bottom surface (e.g., surface 55) of the rim 5. For example, the bores 53*a* are configured to receive fasteners (not shown) to secure a toilet seat to the rim 5. Also for example, the bores 53*b* are configured to receive fasteners (not shown) to secure a tank to the rim 5 (for two-piece toilets). Additional bores 53 in the rim 5 may optionally receive fasteners to secure the rim 5 to the bowl structure 4 in place of or in addition to the bonding material. Although, FIG. 4 shows the surface 54 parallel to the surface 55, such that the rim 5 is a planar, flat member having planar and parallel surfaces, the surfaces 54, 55 can be aligned different (e.g., oblique) or include contour(s). FIG. 2 shows the back portion 51 having an inlet opening 56, which is configured to fluidly connect a tank or other water source (not shown) disposed above the rim 5 to the inlet channel 20.

The rim 5 couples to and abuts an upper surface 44 of the bowl structure 4. For example, the rim 5 can couple (e.g., affix) to the upper surface 44 of the bowl structure 4 by a bonding material and/or one or more fasteners. The bonding material, if employed, can be applied around a portion of or the entire perimeter between the rim 5 and the upper surface 44 of the bowl structure 4. The rim 5 overhangs the shelf 46 of the toilet bowl 40 and is disposed entirely above the water channel 45 of the bowl structure 4 and the inlet channel 20 of the water inlet structure 2 when assembled. Thus, the rim 5 defines a top of a shelf channel extending from the outlet 48 of the water channel 45 and extending between the shelf 46 and the bottom surface 55 of the rim 5. A bottom (e.g., another part of the surface 55) of the rim 5 also defines a top of each of the inlet and water channels upon assembly of the rim structure to the bowl structure. A bonding material and/or one or more fasteners can couple the rim structure (e.g., rim 5) to the bowl structure 4. For example, if the toilet utilizes one or more fasteners, each fastener extends downwardly through one associated bore 53 in the rim 5 and into the upper surface 44 of the bowl structure 4.

Figure 8:
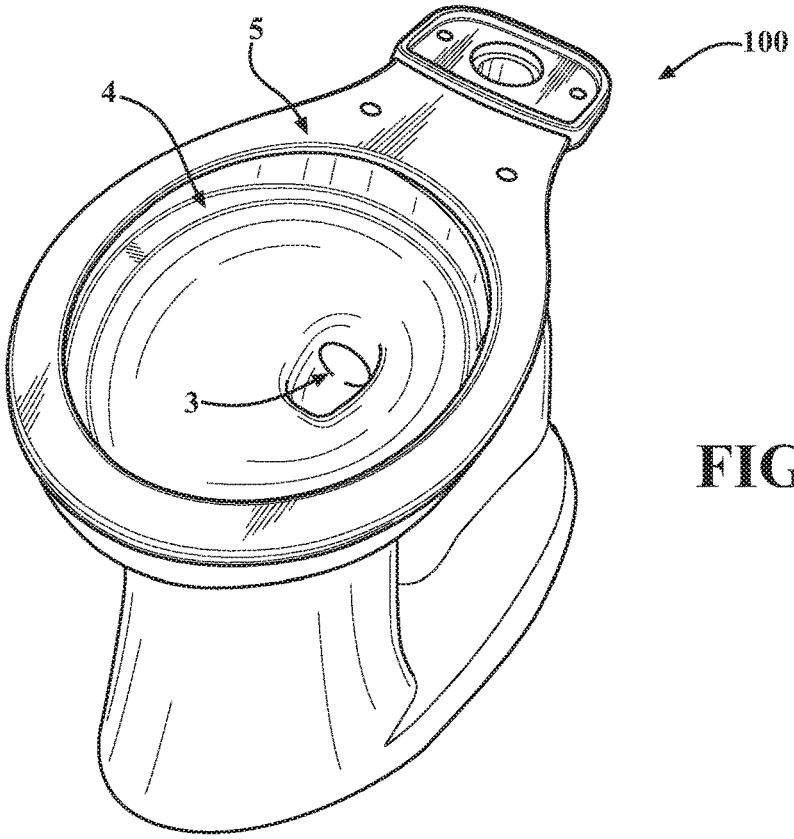
FIG. 8 is a perspective view of a toilet configurable to include the toilet structure, according to this application.
Figure 9:
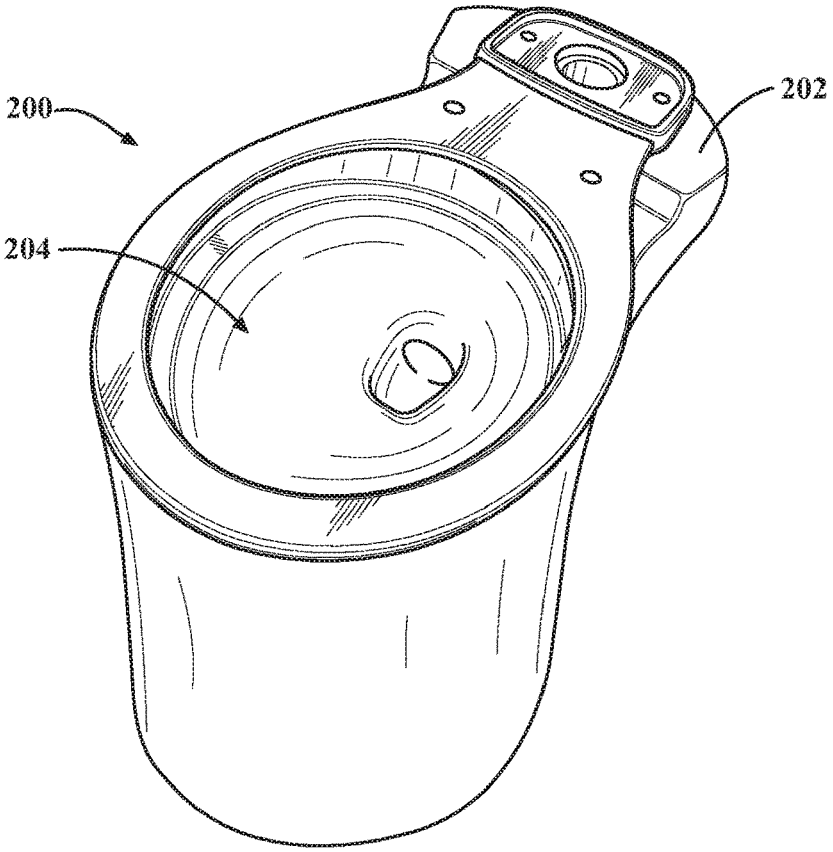
FIG. 9 is a perspective view of another toilet configurable to include the toilet structure, according to this application.

FIGS. 8 and 9 illustrate exemplary embodiments to toilets that are configurable to include the various structural concepts disclosed in this application. FIG. 8 shows an exemplary embodiment of a floor mount toilet 100 having a toilet structure 1, which includes a bowl structure 4 and a rim structure 5. The toilet 100 also includes a water inlet structure 2, which is configurable as disclosed above, such as where the bowl structure 4 and the rim structure 5 define the water inlet structure. FIG. 9 shows another exemplary embodiment of a floor mount toilet 200 configurable to include the toilet structure described in this application. The rim structure (e.g., rim 5), which is described above, couples to a top of the bowl structure 204 shown in FIG. 9 using a bonding material and/or one or more fasteners. The toilet 200 includes a water inlet structure 202, where the bowl structure 204 and the rim structure (e.g., rim 5) define the water inlet structure 202.

As mentioned above, the concepts of this application are configurable with any type of toilet and are not limited to the exemplary embodiments shown and described herein. Further, the specific geometries (e.g., bowl, rim, etc.) shown and described are not limiting, but rather are exemplary embodiments.

The toilet concepts shown and described herein facilitate many improvements in the area of toilets. For example, the flat plate at top of rim can facilitate different geometries that were prohibitive with prior toilets. The concepts are configurable to deliver rim wash with different rim nozzles, which can employ embed nozzles (e.g., single, dual, etc.) into a tile-on piece of the toilet (e.g., the rim). The concepts are configurable with fluidics pieces, which can be formed (e.g., molded-in) with the rim. The concepts are configurable with open rim designs, such as where one would not see water swirling with sloped bowl structure. The concepts are configurable with different tail configurations to fit different bowl to tank coupling pieces for two-piece toilets, as well as with one-piece toilets. As non-limiting examples, the concepts are configurable with tail configurations using bi-lock and tri-lock, as well as dry couplings, snap locks, and other systems. U.S. Pat. No. 9,487,937, which issued on Nov. 8, 2016, describes some examples of such mounting systems.

An exemplary method of assembling or forming the toilets of this application involves a three step process. The first step involves forming a bowl structure that includes a bowl defining an opening at a top thereof and having an outlet, a rear portion extending from a rear of the bowl and having an inlet channel, and a water channel that fluidly connects the bowl to the inlet channel. The bowl structure can be formed (e.g., cast, molded, etc.) in a mold, such as the mold M shown in FIGS. 6 and 7 to produce, for example, the bowl structure shown in FIG. 5. The second step involves forming a rim structure separately from the bowl structure, where the rim structure includes a solid, annular member and a rear portion extending from a rear of the solid, annular member. The rim structure can be formed in a mold, which is different than the mold for forming the bowl structure. The third step involves coupling the rim structure to the bowl structure, such that the solid, annular member is disposed on the top of the bowl and surrounds the opening of the bowl; a bottom of the solid, annular member defines a top of the water channel; and the rear portion of the rim structure is disposed on the rear portion of the bowl, has an inlet opening fluidly connected to the inlet channel, and defines a top of the inlet channel. For example, the bowl structure and the rim structure can be placed in a mold, such as the mold M shown in FIG. 2, to facilitate coupling the structures together.

The third step (or a separate fourth step) may involve coupling the rim structure to the bowl structure by applying a bonding material to the bottom of the solid, annular member and/or the top of the bowl, such that the bonding material forms a watertight seal between the bowl structure and the rim structure. The method may involve heating the bonding material, the rim structure, and the bowl structure to an elevated temperature to bond the rim structure and the bowl structure together. An elevated temperature is a temperature that is high enough above ambient temperature to cure (e.g., fuse, bond, etc.) the rim and bowl structures through the bonding material. Upon curing, the bonding material forms a watertight seal between fused rim and bowl structures. The heating may take place in mold, such as the mold M shown in FIG. 2 or any other suitable mold, or can occur without any such mold(s).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The terms "connected" or "coupled," as used herein, mean the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that the construction and arrangement of the toilets and the components/elements, as shown in the various exemplary embodiments, are illustrative only. Additionally, any element disclosed in one embodiment may be incorporated or utilized with any other embodiment disclosed herein. For example, each inlet structure or component thereof, each bowl structure or component thereof, and/or each rim structure or component thereof described herein may be incorporated into any other embodiment of this application. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A toilet, comprising:

a water inlet structure including an inlet channel configured to receive water from a water source and supply water to a water channel and a jet channel;

a bowl structure including a toilet bowl and the water channel, which is fluidly connected to the water inlet structure and is configured to feed water into the toilet bowl from an outlet of the water channel that is located between a back portion and a side portion of the toilet bowl;

a rim disposed entirely above the water channel and having a solid, annular member disposed around a top of the bowl structure, wherein the rim is formed separately from and coupled to the bowl structure using a bonding material;

a vent hole disposed in the inlet channel and configured to pass air from the jet channel into the inlet channel defined by the rim; and an outlet structure fluidly connected to the toilet bowl to carry the water and contents from the toilet bowl to an outlet, wherein the rim is planar and includes a bottom surface that defines a top of the water channel and the toilet bowl includes a shelf that defines a bottom of the outlet of the water channel and extends from the toilet bowl.

2. The toilet of claim 1, wherein the shelf extends around at least a portion of a perimeter of an upper portion of the toilet bowl.

3. The toilet of claim 2, wherein the shelf is configured to direct water in a single rotational direction around the shelf and an inner surface of the toilet bowl, resulting in a swirl flush.

4. The toilet of claim 1, wherein the bonding material couples the rim to the top of the bowl structure, and the bonding material is disposed around at least a portion of a perimeter between the rim and the top of the bowl structure.

5. The toilet of claim 4, wherein the bonding material is configured to cure in response to being subjected to an elevated temperature.

6. The toilet of claim 4, wherein at least one fastener couples the rim to the bowl structure, and each fastener extends through a bore in the rim and into the bowl structure.

7. The toilet of claim 1, wherein the inlet channel includes a jet supply hole disposed between the water channel and an inlet of the water inlet structure, and the jet supply hole supplies water to the jet channel and a jet in the bowl structure.

8. A toilet pedestal, comprising:

a bowl structure including:

a bowl defining an opening at a top thereof and having an outlet;

a rear portion extending from a rear of the bowl and having an inlet channel;

a shelf that extends from the bowl; and a water channel having an outlet that fluidly connects the bowl to the inlet channel;

a vent hole disposed in the inlet channel configured to pass air from a jet channel into the inlet channel; and a rim structure separate from and coupled to the bowl structure, the rim structure including:

a solid, annular member disposed on the top of the bowl and around the opening of the bowl, a bottom of the solid, annular member defining a top of the water channel; and a rear portion disposed on the rear portion of the bowl and having an inlet opening fluidly connected to the inlet channel, wherein the rear portion of the rim structure defines a top of the inlet channel, wherein the bottom of the solid, annular member defines a top of the outlet of the water channel and the shelf defines a bottom of the outlet of the water channel; and the inlet channel is configured to supply water to the water channel and the jet channel.

9. The toilet pedestal of claim 8, wherein the bowl structure includes a rear wall, which defines a rear of the bowl, and a side wall, which defines a side of the bowl, wherein the rear and side walls define the water channel and an outlet thereof.

10. The toilet pedestal of claim 9, wherein the shelf extends around at least a portion of a perimeter of the bowl.

11. The toilet pedestal of claim 8, wherein at least one of the bottom of the solid, annular member or the top of the bowl is planar.

12. The toilet pedestal of claim 8, wherein a bonding material couples the bottom of the solid, annular member to the top of the bowl, and the bonding material forms a watertight seal between the bowl structure and the rim structure.

13. The toilet pedestal of claim 12, wherein the bonding material is configured to cure in response to being subjected to an elevated temperature.

14. The toilet pedestal of claim 13, wherein the bowl structure includes a jet supply hole disposed between the water channel and an inlet of the inlet channel, and the jet supply hole supplies water to a jet in the bowl structure.

15. A method of forming a toilet, comprising:

forming a bowl structure that includes:

a bowl defining an opening at a top thereof and having an outlet;

a rear portion extending from a rear of the bowl and having an inlet channel; and a water channel that fluidly connects the bowl to the inlet channel;

a vent hole disposed in the inlet channel and configured to pass air from a jet channel into the inlet channel;

a shelf that defines a bottom of an outlet of the water channel and extends from the bowl;

forming a rim structure separately from the bowl structure, the rim structure including:

a solid, annular member; and a rear portion extending from a rear of the solid, annular member; and coupling the rim structure to the bowl structure, wherein the solid, annular member is disposed on the top of the bowl and surrounds the opening of the bowl;

a bottom of the solid, annular member defines a top of the water channel and a top of the outlet of the water channel;

the rear portion of the rim structure is disposed on the rear portion of the bowl, has an inlet opening fluidly connected to the inlet channel, and defines a top of the inlet channel; and the inlet channel is configured to supply water to the water channel and the jet channel.

16. The method of forming the toilet of claim 15, wherein coupling the rim structure to the bowl structure comprises applying a bonding material to at least one of the bottom of the solid, annular member or the top of the bowl, and the bonding material forms a watertight seal between the bowl structure and the rim structure.

17. The method of forming the toilet of claim 16, further comprising heating the bonding material, the rim structure, and the bowl structure to an elevated temperature to bond the rim structure and the bowl structure together.

18. The toilet of claim 1, wherein the vent hole is a downwardly extending bore disposed on a ledge elevated from a bottom of the inlet channel.

19. The toilet pedestal of claim 8, wherein the vent hole is a downwardly extending bore disposed on a ledge elevated from a bottom of the inlet channel.

20. The method of claim 15, wherein the vent hole is a downwardly extending bore disposed on a ledge elevated from a bottom of the inlet channel.

* * * * *